US011380239B2

(12) United States Patent
Kidoguchi et al.

(10) Patent No.: US 11,380,239 B2
(45) Date of Patent: Jul. 5, 2022

(54) IMAGE PROCESSING SYSTEM, IMAGE PROCESSING DEVICE, AND COMPUTER PROGRAM

(71) Applicant: EIZO Corporation, Hakusan (JP)

(72) Inventors: Satomi Kidoguchi, Hakusan (JP); Takashi Nakamae, Hakusan (JP); Reo Aoki, Hakusan (JP); Masataka Shoji, Hakusan (JP)

(73) Assignee: EIZO Corporation, Hakusan (JP)

( * ) Notice: Subject to any disclaimer, the term of this patent is extended or adjusted under 35 U.S.C. 154(b) by 0 days.

(21) Appl. No.: 17/289,551

(22) PCT Filed: Nov. 7, 2019

(86) PCT No.: PCT/JP2019/043749

§ 371 (c)(1),
(2) Date: Apr. 28, 2021

(87) PCT Pub. No.: WO2020/100724

PCT Pub. Date: May 22, 2020

(65) Prior Publication Data

US 2021/0398471 A1 Dec. 23, 2021

(30) Foreign Application Priority Data

Nov. 12, 2018 (WO) ..... PCT/JP2018/041871

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 2300/0452* (2013.01); *G09G 2360/144* (2013.01)

(58) Field of Classification Search
None
See application file for complete search history.

(56) References Cited

U.S. PATENT DOCUMENTS

2001/0050757 A1* 12/2001 Yoshida ..... G09G 3/3607 353/69
2002/0057835 A1* 5/2002 Wada ..... H04N 9/67 348/E9.051

(Continued)

FOREIGN PATENT DOCUMENTS

JP 2002-041017 A 2/2002
KR 10-2005-0059522 A 6/2005

OTHER PUBLICATIONS

International Search Report dated Feb. 4, 2020 in corresponding International Application No. PCT/JP2019/043749; 5 pages.

*Primary Examiner* — Patrick N Edouard
*Assistant Examiner* — Peijie Shen
(74) *Attorney, Agent, or Firm* — Maier & Maier, PLLC

(57) ABSTRACT

The visibility of a display device under colored ambient light is improved. There is provided an image processing system for converting a color space represented by color components of image data. The image processing system includes a color space converter configured to correct the color components of the image data by converting the color space such that, with respect to particular color components in user-perceived color gamut widened by influence of chromatic adaptation caused by ambient light, the influence is maintained and such that, with respect to particular color components in user-perceived color gamut narrowed by the influence, the influence is canceled; and a display unit configured to display, as an output image, the image data using the corrected color components.

18 Claims, 14 Drawing Sheets

(56) References Cited

U.S. PATENT DOCUMENTS

2002/0080245 A1* 6/2002 Parulski ..... H04N 9/735 348/333.01
2002/0118182 A1* 8/2002 Luther Weindorf ..... G09G 3/20 345/204
2003/0016862 A1* 1/2003 Ohga ..... H04N 1/6088 382/162
2003/0035157 A1* 2/2003 Kanai ..... H04N 9/67 358/1.9
2003/0234793 A1* 12/2003 Stokes ..... H04N 9/64 348/E9.037
2005/0068332 A1* 3/2005 Diefenbaugh ..... H04N 1/6027 345/604
2005/0212824 A1* 9/2005 Marcinkiewicz .... G09G 3/3406 345/690
2006/0082844 A1* 4/2006 White ..... H04N 1/54 358/504
2007/0035706 A1* 2/2007 Margulis ..... H04N 9/3102 353/122
2007/0058186 A1* 3/2007 Tanaka ..... H04N 1/6088 358/1.9
2008/0303918 A1* 12/2008 Keithley ..... G09G 3/20 348/223.1
2009/0046928 A1* 2/2009 Kwak ..... H04N 1/608 382/167
2009/0121641 A1* 5/2009 Shih ..... G01J 1/32 315/157
2009/0237423 A1* 9/2009 Shih ..... G09G 3/3406 345/102
2011/0050695 A1* 3/2011 Sullivan ..... G09G 5/02 345/426
2011/0199350 A1* 8/2011 Wilson ..... G09G 5/02 345/207
2013/0105668 A1* 5/2013 Ho ..... G09G 3/3466 250/2 UAL
2013/0293567 A1* 11/2013 Shigeta ..... G09G 3/2003 345/589
2014/0063039 A1* 3/2014 Drzaic ..... G09G 5/02 345/589
2014/0160137 A1* 6/2014 Martin ..... G06F 12/00 359/291
2014/0268025 A1* 9/2014 Legerton ..... G02C 7/10 351/159.61
2015/0015597 A1* 1/2015 Sano ..... H04N 1/6058 345/590
2015/0245043 A1* 8/2015 Greenebaum ..... H04N 19/177 375/240.25
2017/0169751 A1* 6/2017 Ando ..... G09G 5/02
2017/0280029 A1 9/2017 Steiner
2017/0303365 A1* 10/2017 Chen ..... H05B 45/20
2018/0204525 A1* 7/2018 Comps ..... G09G 3/3406
2018/0278965 A1* 9/2018 Dsouza ..... H04N 19/124
2019/0098179 A1* 3/2019 Hung ..... H04N 5/58
2019/0362688 A1* 11/2019 Wang ..... G06F 3/0484
2020/0013151 A1* 1/2020 Atkins ..... G06T 5/009
2020/0118521 A1* 4/2020 Facchin ..... G09G 5/02
2020/0126512 A1* 4/2020 Amin ..... G09G 5/003
2021/0329764 A1* 10/2021 Linder ..... G02C 11/10

* cited by examiner

FIG. 3 (Embodiment 1)
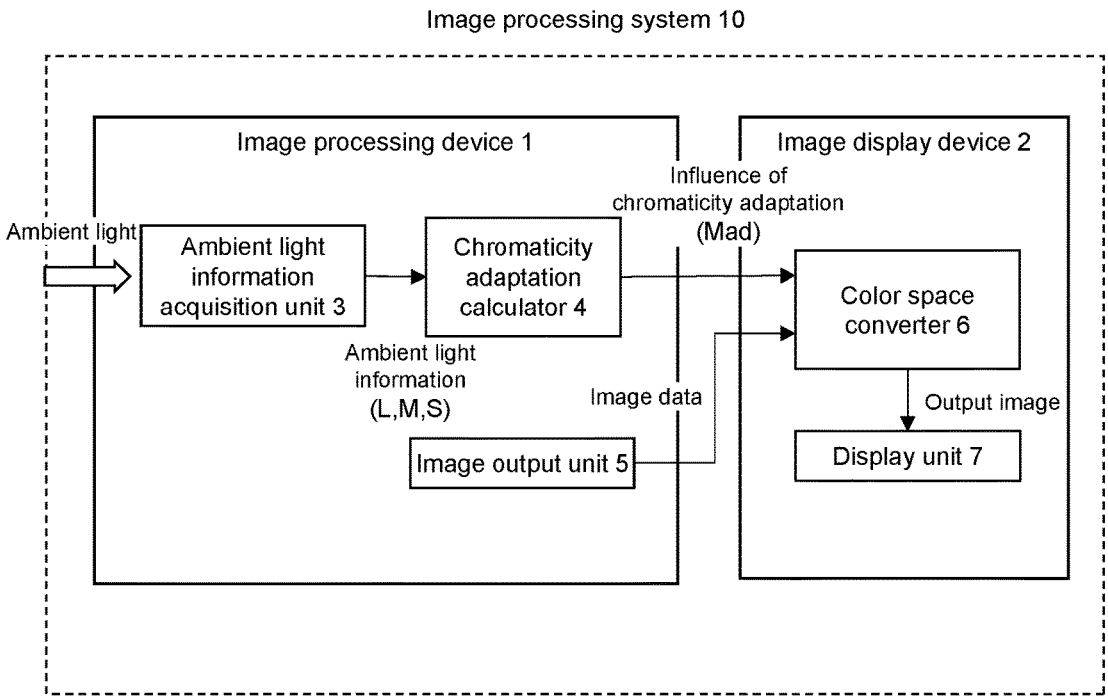

FIG. 7A (Modification 1)
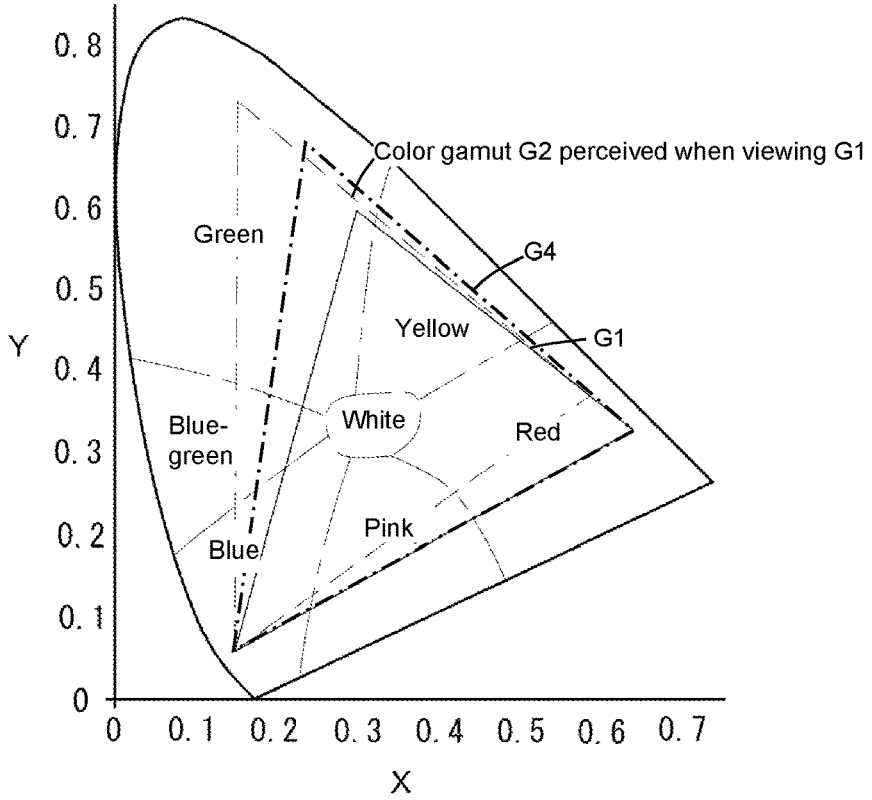
FIG. 7B (Modification 1)
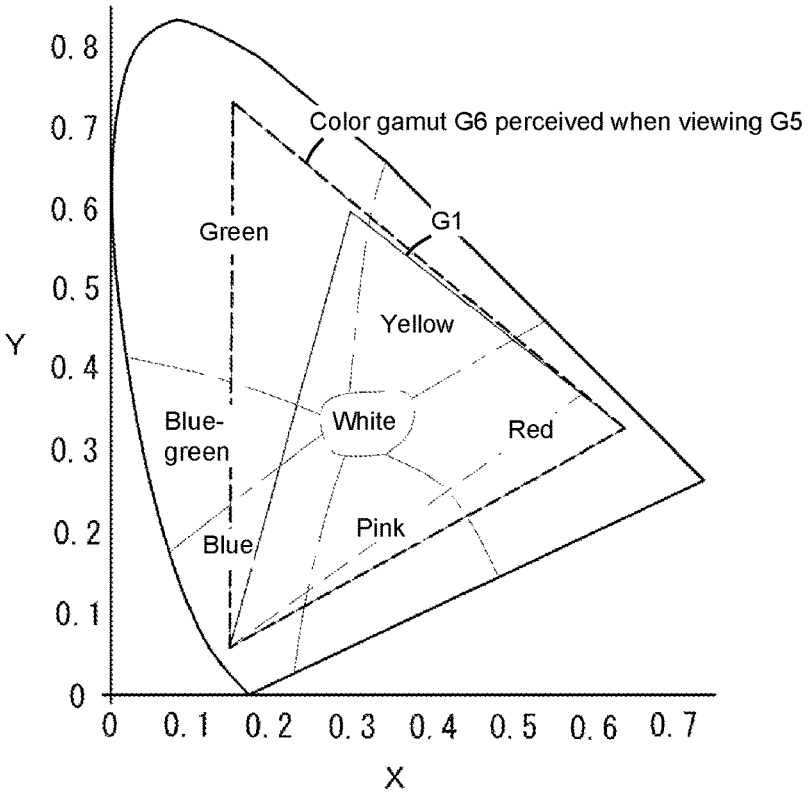

FIG. 8A (Modification 2)
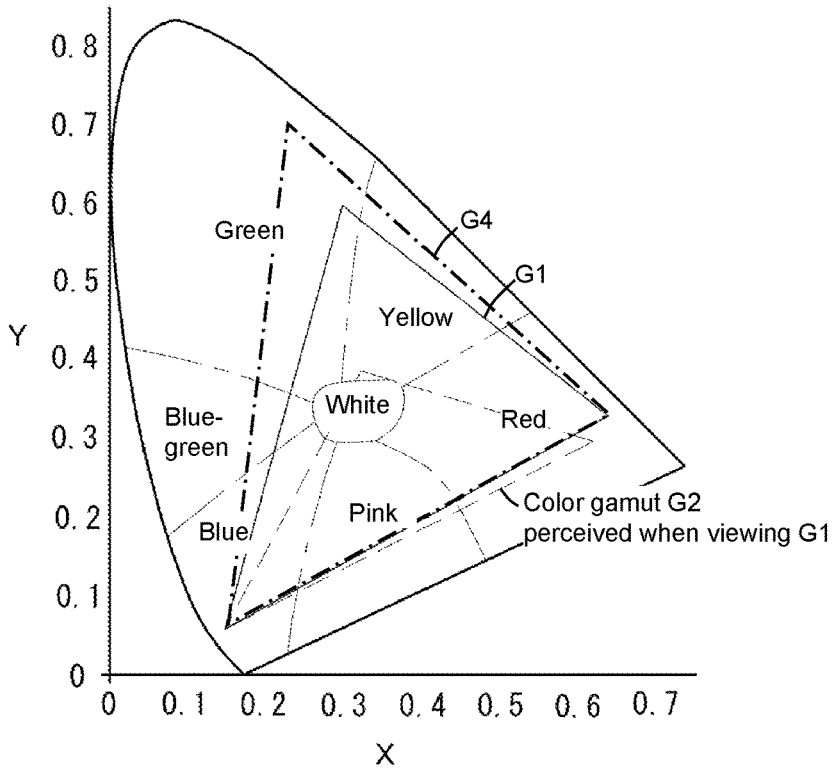
FIG. 8B (Modification 2)
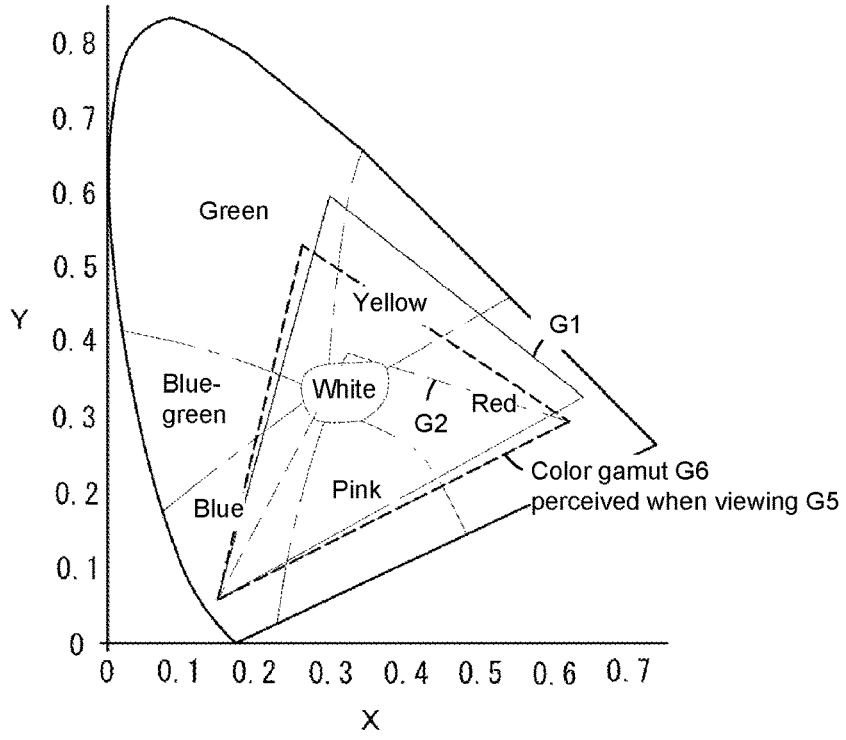

FIG. 9A (Modification 3)
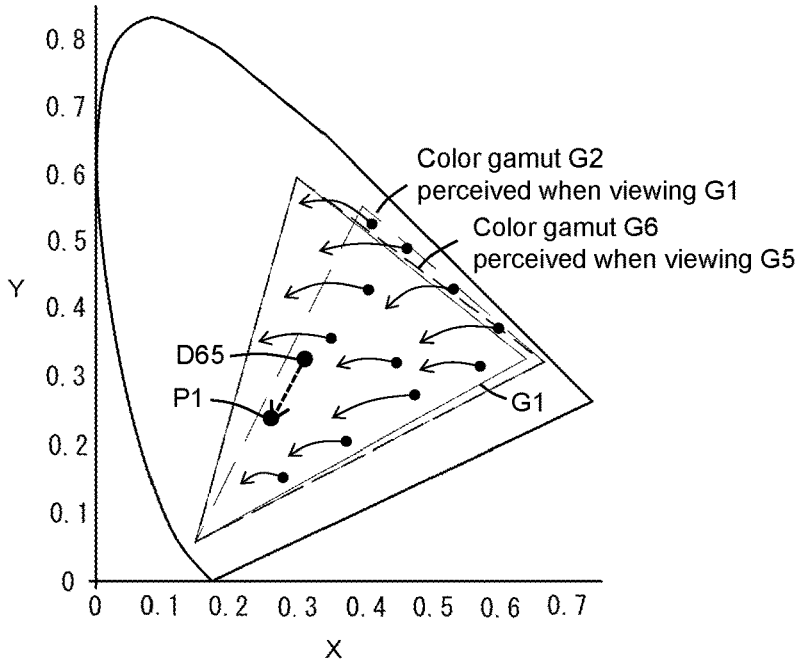
FIG. 9B (Modification 3)
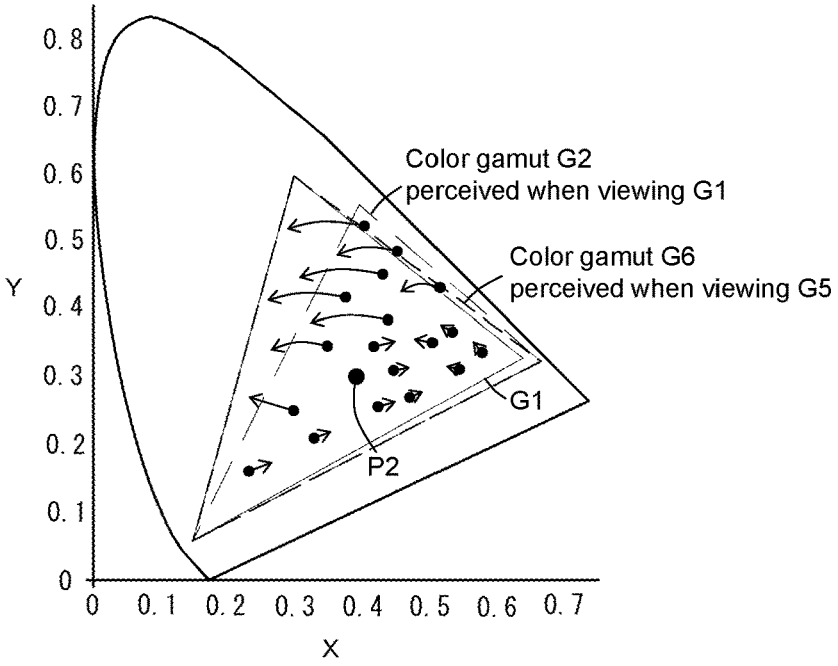

FIG. 10 (Embodiment 2)
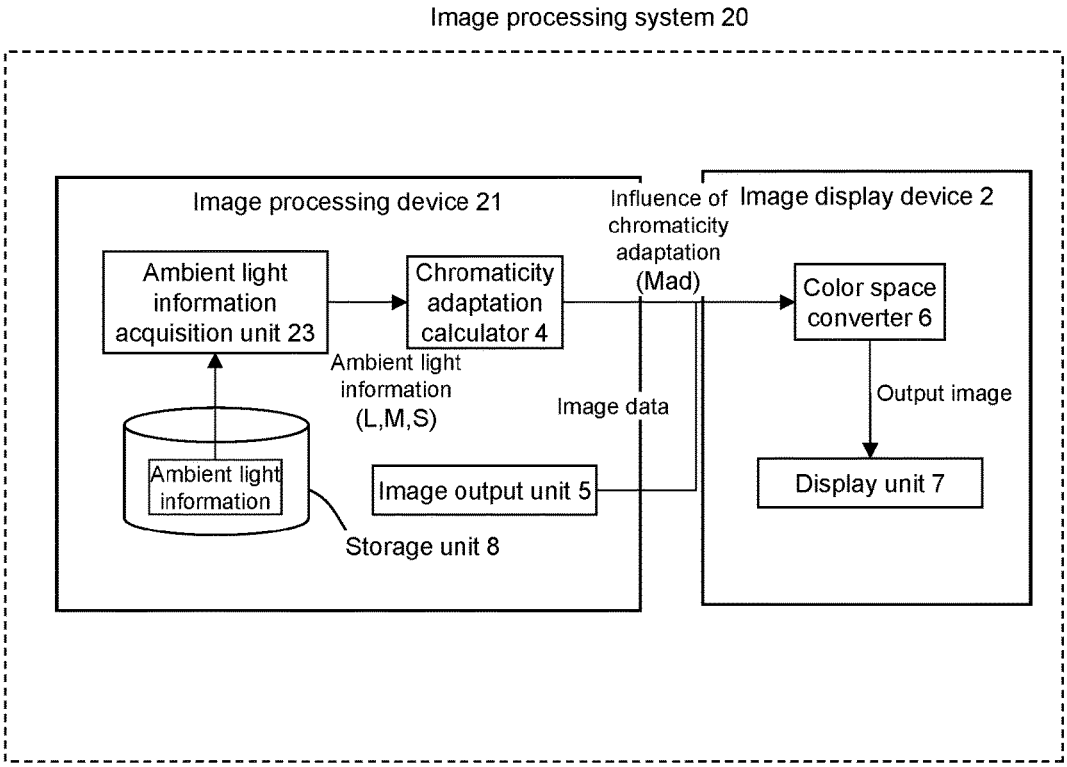

FIG. 11 (Embodiment 3)
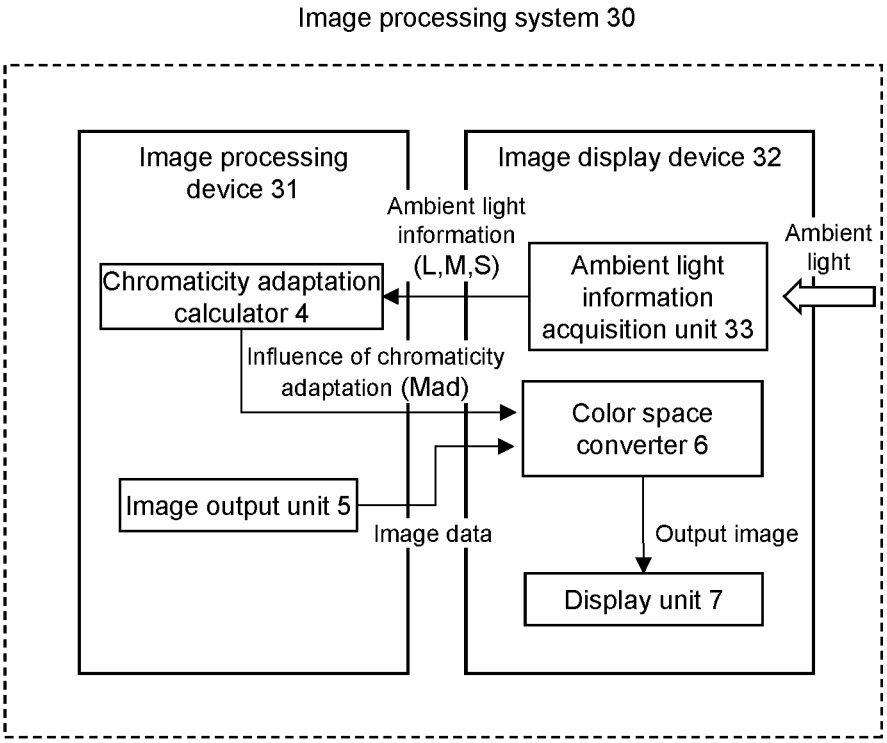

FIG. 12 (Embodiment 4)
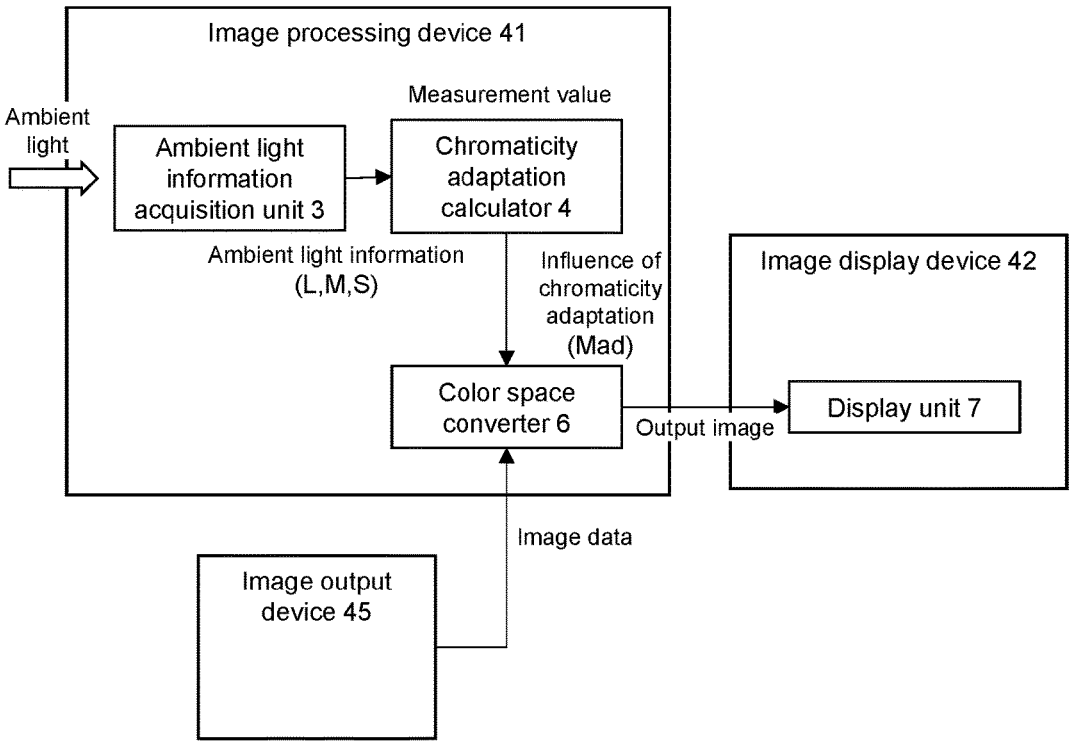

FIG. 13 (Embodiment 5)
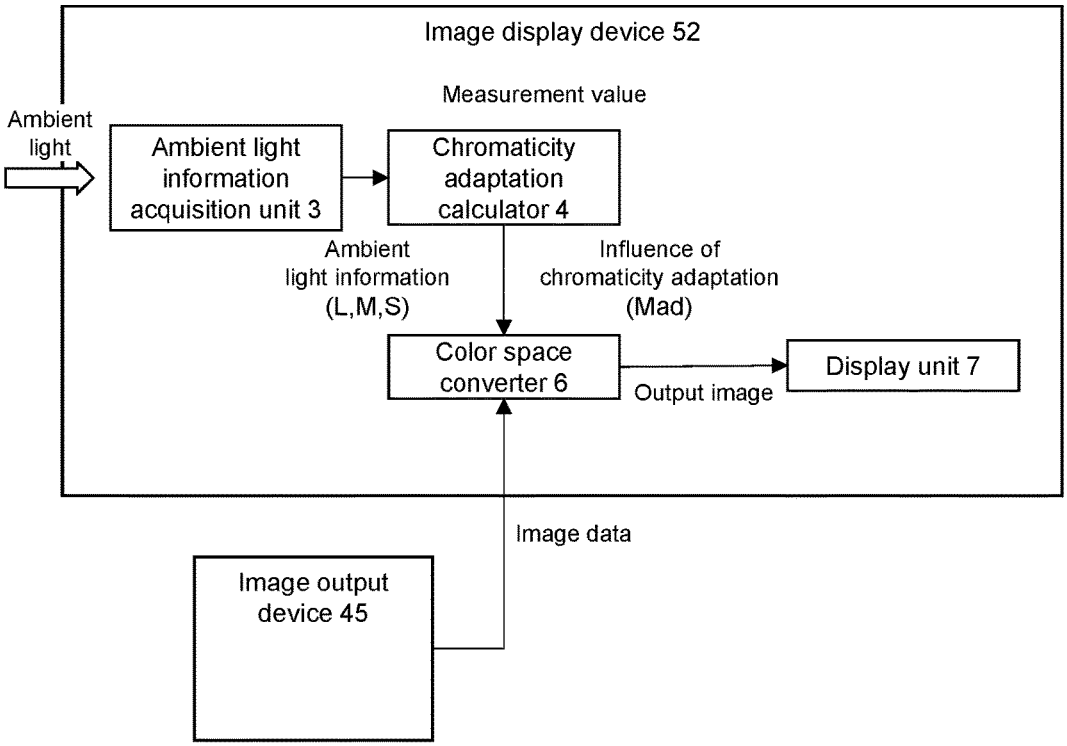

FIG. 14 (Another embodiment)
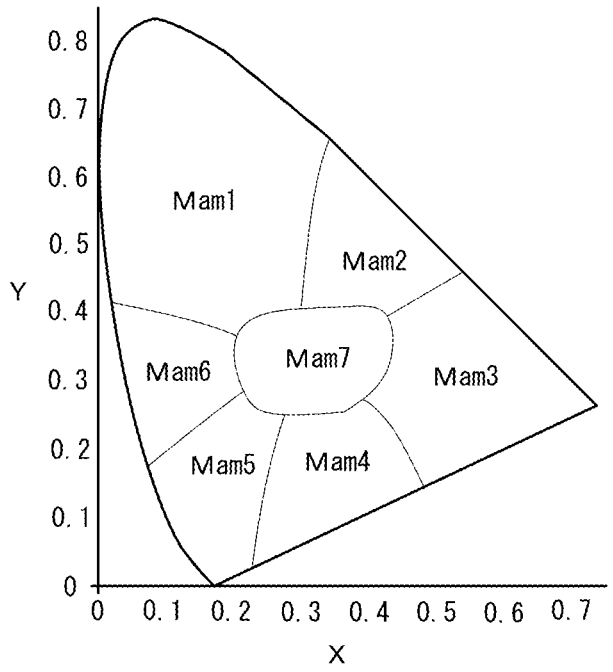

IMAGE PROCESSING SYSTEM, IMAGE PROCESSING DEVICE, AND COMPUTER PROGRAM

TECHNICAL FIELD

The present invention relates to an image processing system, image processing device, and computer program.

BACKGROUND ART

Cases in which a display device is used under particular colored ambient light have been increased in recent years. It is known that a phenomenon called "chromatic adaptation" occurs with respect to the perception of a human under such colored ambient light. The term "chromatic adaptation" means that a human perceives the color of the same object as a color different from a color perceived under white light by adapting to ambient light.

Under the influence of chromatic adaptation, there occurs a phenomenon in which particular color components are more likely to be perceived, while other color component are less likely to be perceived. For this reason, Patent Literature 1, for example, discloses an image processing device that cancels chromatic adaptation so that colors perceived by a user do not change even if ambient light changes.

CITATION LIST

Patent Literature

[Patent Literature 1] JP-A-2002-41017

SUMMARY OF INVENTION

Technical Problem

However, the technology of Patent Literature 1 cancels the influence of chromatic adaptation and therefore also cancels the advantage of chromatic adaptation that makes the particular color components more likely to be perceived.

The present invention has been made in view of the foregoing, and an object thereof is to improve the visibility of display devices under colored ambient light.

Solution to Problem

The present invention provides an image processing system for converting a color space represented by color components of image data. The image processing system includes a color space converter configured to correct the color components of the image data by converting the color space such that, with respect to particular color components in user-perceived color gamut widened by influence of chromatic adaptation caused by ambient light, the influence is maintained and such that, with respect to particular color components in user-perceived color gamut narrowed by the influence, the influence is canceled and a display unit configured to display, as an output image, the image data using the corrected color components.

This configuration cancels the influence of the chromatic adaptation with respect to only the particular color components in the color gamut narrowed by the influence of the chromatic adaptation and therefore allows the color components in the color gamut widened by the influence of the chromatic adaptation to be perceived as more vivid colors. That is, this configuration is able to reduce the influence of the chromatic adaptation with respect to only the particular color components while enjoying the advantage of the chromatic adaptation, resulting in an improvement in the visibility of displays under colored ambient light.

Various embodiments of the present invention are described below. Any of the embodiments described below can be combined with each other. Respective features independently form the invention.

Preferably, the image processing system further includes an ambient light information acquisition unit configured to acquire information on the ambient light as ambient light information and a chromatic adaptation calculator configured to calculate the influence of the chromatic adaptation caused by the ambient light on the basis of the acquired ambient light information and to output the influence of the chromatic adaptation to the color space converter.

Preferably, if the color components include three primary colors consisting of red, green, and blue, the ambient light is a bluish color and the particular color components include a greenish color.

Preferably, if the color components include three primary colors consisting of red, green, and blue, the ambient light is a reddish color and the particular color components include a reddish color.

Preferably, if the color components include three primary colors consisting of red, green, and blue, the ambient light is a greenish color and the particular color components include a reddish color and/or a greenish color.

Preferably, the display unit is configured to be able to display wider color gamut than the converted color space.

Preferably, if the converted color space exceeds color gamut displayable on the display unit, the color space converter performs a rounding process on the color space so that the color space falls within the color gamut.

Preferably, the color space of the image data is an sRGB color space, and a color space displayable on the display unit is color gamut defined by red where X=0.640 and Y=0.330, green where X=0.210 and Y=0.710, and blue where X=0.150 and Y=0.060.

Preferably, the color space converter is configured to allow the user to control a degree of correction of the color components.

Preferably, the image processing system further includes a color sensor configured to detect color components of the ambient light as ambient light information.

Preferably, the chromatic adaptation calculator calculates the influence of the chromatic adaptation by averaging the ambient light information detected by a color sensor in a predetermined period.

Preferably, the color space converter sets reference chromaticity serving as a reference in conversion of the color space so that the influence of the chromatic adaptation on intermediate colors is further canceled.

Preferably, the reference chromaticity is chromaticity perceived as white due to influence of the ambient light.

Preferably, the reference chromaticity is chromaticity belonging to a color component in perceived color gamut widened by the influence of the ambient light.

Preferably, the color space converter performs different conversion processes on multiple areas in the color space.

Another aspect of the present invention provides an image processing device for converting a color space represented by color components of image data. The image processing device includes a color space converter configured to correct the color components of the image data by converting the color space such that, with respect to particular color components in user-perceived color gamut widened by influence of chromatic adaptation caused by ambient light, the influence is maintained and such that, with respect to particular color components in user-perceived color gamut narrowed by the influence, the influence is canceled.

Yet another aspect of the present invention provides an image processing method for converting a color space represented by color components of image data. The image processing method includes a color space conversion step of correcting the color components of the image data by converting the color space such that, with respect to particular color components in user-perceived color gamut widened by influence of chromatic adaptation caused by ambient light, the influence is maintained and such that, with respect to particular color components in user-perceived color gamut narrowed by the influence, the influence is canceled.

Still yet another aspect of the present invention provides a computer program for causing a computer to perform an image processing method for converting a color space represented by color components of image data, the image processing method comprising a color space conversion step of correcting the color components of the image data by converting the color space such that, with respect to particular color components in user-perceived color gamut widened by influence of chromatic adaptation caused by ambient light, the influence is maintained and such that, with respect to particular color components in user-perceived color gamut narrowed by the influence, the influence is canceled.

BRIEF DESCRIPTION OF DRAWINGS

FIG. 3 is a block diagram showing the functional configuration of the image processing system 10.

FIG. 7A is a chromaticity diagram showing the influence of chromatic adaptation in a modification 1, and FIG. 7B is a chromaticity diagram showing changes in the color gamut by color space conversion in the modification 1.

FIG. 8A is a chromaticity diagram showing the influence of chromatic adaptation in a modification 2, and FIG. 8B is a chromaticity diagram showing changes in the color gamut by color space conversion in the modification 2.

FIG. 9A is a chromaticity diagram showing an example of the correction of intermediate colors in a modification 3, and FIG. 9B is a chromaticity diagram showing another example of the correction of intermediate colors in the modification 3.

FIG. 10 is a block diagram showing the functional configuration of an image processing system 20 according to a second embodiment.

FIG. 11 is a block diagram showing the functional configuration of an image processing system 30 according to a third embodiment.

FIG. 12 is a block diagram showing the functional configuration of an image processing device 41 according to a fourth embodiment.

FIG. 13 is a block diagram showing the functional configuration of an image processing device 52 according to a fifth embodiment.

FIG. 14 is a graph showing an example of setting of conversion matrixes on respective color gamuts in another embodiment.

DESCRIPTION of EMBODIMENTS

1. Changes in Color Gamut by Influence of Chromatic Adaptation

Figure 1:
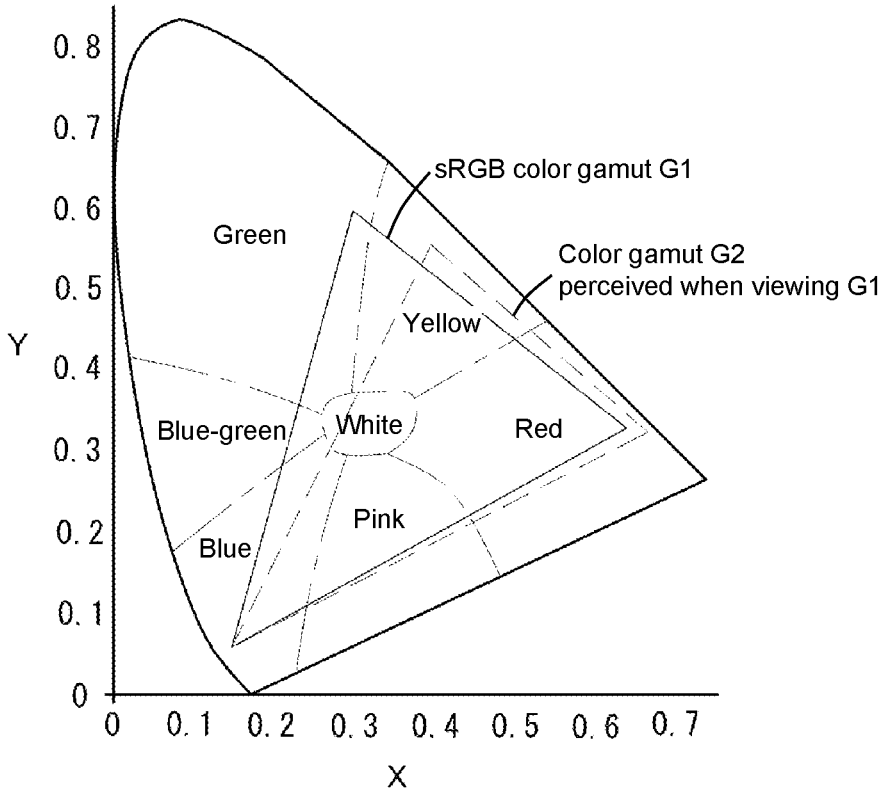
FIG. 1 is a graph showing changes in the color gamut by the influence of chromatic adaptation.

Referring to FIG. 1, changes in the color gamut by the influence of chromatic adaptation will be described. FIG. 1 shows sRGB color gamut G1 and color gamut G2 perceived by a human when viewing the color gamut G1 under predetermined blue ambient light.

As shown in FIG. 1, the color gamut G2 perceived when viewing the color gamut G1 under the blue ambient light is displaced from the color gamut G1 so as to be widened in the direction of red compared to the color gamut G1. This means that the red component in the direction of the complementary color is perceived more vividly under the blue ambient light. On the other hand, the color gamut G2 appears to be narrowed in the direction of green compared to the color gamut G1. This means that the green component is less likely to be perceived.

Such cases in which the color gamut is influenced by chromatic adaptation include endoscopic surgery under blue ambient light. In an operating room under blue light, those involved in surgery perform surgery while watching a display displaying image data from an endoscope. At this time, those involved in surgery more vividly perceive the red component displayed on the display, while they are less likely to perceive the green component. This can be explained as being caused by changes in the color gamut by the influence of chromaticity adaptation described above.

As seen above, it is advantageous for those involved in surgery that the red component is more vividly perceived under blue ambient light, while it is disadvantageous for them that the green component is less likely to be perceived. In view of the foregoing, the inventors of the present application have invented an image processing system that converts the color space such that, with respect to only particular color components in user-perceived color gamut narrowed by the influence of chromaticity adaptation, the influence is canceled. The configuration thereof will be described below.

2. First Embodiment (2.1. Hardware Configuration of Image Processing System 10)

Figure 2:
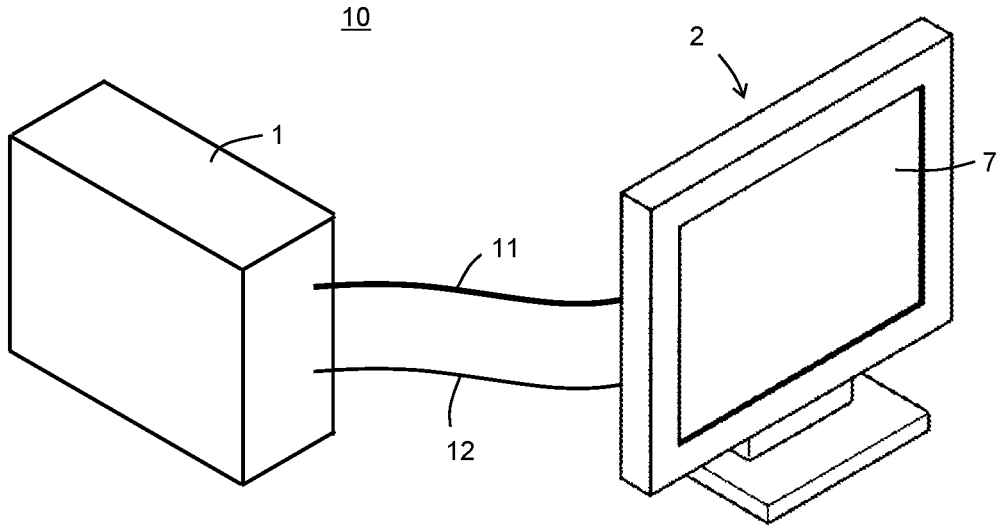
FIG. 2 is a diagram showing the hardware configuration of an image processing system 10 according to a first embodiment.

Referring to FIG. 2, the hardware configuration of an image processing system 10 will be described. As shown in FIG. 2, the image processing system 10 includes an image processing device 1 and an image display device 2. The image processing device 1 and image display device 2 are configured to be able to communicate with each other through a video signal cable 11 and a control signal cable 12.

The image processing device 1 transmits image data to the image display device 2 through the video signal cable 11. Images based on the image data are displayed on a display unit 7 of the image display device 2. The image processing device 1 and image display device 2 transmit and receive control signals and data to and from each other through the control signal cable 12.

The image processing device 1 is connected to, for example, an endoscopic examination device (not shown). Thus, those involved in endoscopic surgery are able to visually check images outputted from the endoscopic examination device on the display unit 7.

(2.2. Functional Configuration of Image Processing System 10)

Referring to FIG. 3, the functional configuration of the image processing system 10 will be described. As shown in FIG. 3, the image processing device 1 includes an ambient light information acquisition unit 3, a chromatic adaptation calculator 4, and an image output unit 5. The image display device 2 includes a color space converter 6 and the display unit 7.

The ambient light information acquisition unit 3 acquires, as ambient light information, the LMS values of ambient light under which the image processing device 1 is disposed, using, for example, a color sensor that detects the color of the ambient light. The LMS values are also called "cone stimulus values" and are physical quantities for defining the color on the basis of the response of the photoreceptors (cones) of a human to the hue.

The chromatic adaptation calculator 4 calculates the influence of chromatic adaptation caused by the ambient light on the basis of the ambient light information acquired by the ambient light information acquisition unit 3. The chromatic adaptation calculator 4 may calculate the influence of chromatic adaptation on the basis of ambient light information detected by the ambient light information acquisition unit 3 at predetermined time intervals, or may calculate the influence of chromatic adaptation by averaging measurement values detected by the ambient light information acquisition unit 3 in a predetermined period. Details of the process performed by the chromatic adaptation calculator 4 will be described later.

The image output unit 5 outputs image data to be displayed on the display unit 7 of the image display device 2. For example, the image data includes color components including three primary colors consisting of red, green, and blue and has a color space represented by the color components. As used herein, the term "color space" refers to a space formed by values that can be taken by the color components.

The color space converter 6 corrects the color components of the image data by converting the color space of the image data such that, with respect to only particular color components in user-perceived color gamut narrowed by the influence of chromaticity adaptation, the influence is canceled. As used herein, the term "color gamut" refers to the range of values that can be taken by the color components and is a concept that can be included in the color space. Details of the process performed by the color space converter 6 will be described later.

The above elements may be implemented by software or hardware. In the case of software, the elements are implemented by execution of a program by the CPU. The program may be stored in a storage unit included in the image processing device 1 or image display device 2 (memory, HDD, SSD or the like), or may be stored in a non-transitory computer-readable storage medium. It is also possible to read the program from an external storage unit and to implement the elements by execution of the program by so-called "cloud computing." In the case of hardware, the elements are implemented by various types of circuits, such as ASIC, FPGA, and DRP.

The display unit 7 displays the image data as images and consists of, for example, a liquid crystal display panel, organic EL display panel, touchscreen display, electronic paper, or other type of display. The display unit 7 displays, as output images, the image data using the color components corrected by the color space converter 6.

(2.3. Process by Chromatic Adaptation Calculator 4)

The process performed by the chromatic adaptation calculator 4 will be described. Note that conversion formulas and conversion matrixes described below are only illustrative and not limiting.

The chromatic adaptation calculator 4 calculates the influence of chromatic adaptation under ambient light. Various formulas for calculating the influence of chromatic adaptation are already known. For example, the CIECAM02 model provides the following Formulas (1) and (2).

[Formula 1]

$$\begin{pmatrix} Lc \\ Mc \\ Sc \end{pmatrix} = Mad \begin{pmatrix} L \\ M \\ S \end{pmatrix} \tag{1}$$

[Formula 2]

$$Mad = \begin{pmatrix} LpD + 1 - D & 0 & 0 \\ 0 & MpD + 1 - D & 0 \\ 0 & 0 & SpD + 1 - D \end{pmatrix} \tag{2}$$

In Formula (1), L, M, and S represent the LMS values of an object under white light, and Lc, Mc, and Sc represent the LMS values of the object perceived by a human under ambient light. In Formula (2), Lp, Mp, and Sp represent the ratios in the LMS values between white light and ambient light and represent the amounts changed by the influence of the ambient light. D is called "adaptation factor," is a physical quantity representing the degree of adaptation of the user to the environment, and is properly set between 0 and 1 in accordance with the environment.

Mad in Formula (2) is called "chromatic adaptation conversion matrix" and represents the influence of chromatic adaptation caused by the ambient light. As shown in Formula (1), by performing the operation of the chromatic adaptation conversion matrix on the LMS values of the object under white light, the LMS values of the object perceived by the human under the ambient light are calculated.

The chromatic adaptation calculator 4 calculates the chromatic adaptation conversion matrix Mad on the basis of the ambient light information (LMS values) transmitted from the ambient light information acquisition unit 3 and transmits the calculated chromatic adaptation conversion matrix Mad to the color space converter 6 as the influence of chromatic adaptation.

(2.4. Process by Color Space Converter 6)

Figure 4A:
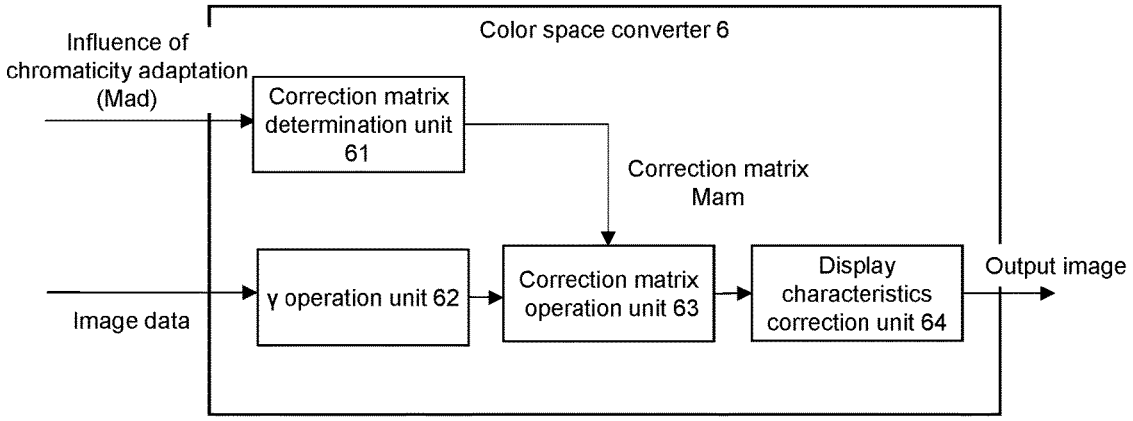
FIG. 4A is a block diagram showing the functional configuration of a color space converter 6.

Referring to FIG. 4A, the process performed by the color space converter 6 will be described. As shown in FIG. 4A, the color space converter 6 includes a correction matrix determination unit 61, a γ operation unit 62, a correction matrix operation unit 63, and a display characteristics correction unit 64.

The correction matrix determination unit 61 determines a correction matrix Mam for canceling the influence of the ambient light with respect to only particular color components of the image data, on the basis of the chromatic adaptation conversion matrix Mad representing the influence of chromatic adaptation and transmitted from the chromatic adaptation calculator 4. Details of the process performed by the correction matrix determination unit 61 will be described later.

The γ operation unit 62 determines a gradation characteristic (γ curve) to be displayed on the display unit 7, with respect to the image data transmitted from the image output unit 5 and performs γ correction on the image data. The γ operation unit 62 transmits the image data whose gradation characteristic has been determined, to the correction matrix operation unit 63.

The correction matrix operation unit 63 performs an operation on the image data using the correction matrix Mam determined by the correction matrix determination unit 61. The correction matrix operation unit 63 transmits the image data after the operation with the correction matrix Mam to the display characteristics correction unit 64. Details of the process performed by the correction matrix operation unit 63 will be described later.

The display characteristics correction unit 64 performs a correction process in accordance with display characteristics of the display unit 7. The display characteristics correction unit 64 displays the resulting image data on the display unit 7 as output images.

(2.5. Processes by Correction Matrix Determination Unit 61 and Correction Matrix Operation Unit 63)

Referring to FIGS. 4B to 6B, the processes performed by the correction matrix determination unit 61 and correction matrix operation unit 63 will be described. In the description below, for example, it is assumed that the ambient light is bluish light, the color gamut of the color components of the image data is sRGB, and the color gamut as display characteristics of the display unit 7 is Adobe RGB® (red: X=0.640, Y=0.330, green: X=0.210, Y=0.710, blue: X=0.150, Y=0.060).

In step S1, the correction matrix determination unit 61 obtains color gamut G3 by performing color gamut conversion represented by Formulas (3) to (5) on the sRGB color gamut G1, which is the color gamut of the image data, on the basis of the chromatic adaptation conversion matrix Mad transmitted from the chromatic adaptation calculator 4.

[Formula 3]

$$\begin{pmatrix} L \\ M \\ S \end{pmatrix}_{G1} = Mxl \begin{pmatrix} X \\ Y \\ Z \end{pmatrix}_{G1} \tag{3}$$

[Formula 4]

$$\begin{pmatrix} L \\ M \\ S \end{pmatrix}_{G3} = Mad^{-1} \begin{pmatrix} L \\ M \\ S \end{pmatrix}_{G1} \tag{4}$$

[Formula 5]

$$\begin{pmatrix} X \\ Y \\ Z \end{pmatrix}_{G3} = Mlx \begin{pmatrix} L \\ M \\ S \end{pmatrix}_{G1} \tag{5}$$

Mxl in Formula (3) is a conversion matrix for converting the XYZ values into LMS values. The XYZ values are physical quantities for representing a color using an XYZ colorimetric system and are used when drawing a chromaticity diagram. As an example, the CIECAM02 model provides the following conversion matrix as Mxl.

[Formula 6]

$$Mxl = \begin{pmatrix} 0.732 & 0.429 & -0.162 \\ -0.703 & 1.697 & 0.006 \\ 0.003 & 0.013 & 0.983 \end{pmatrix} \tag{6}$$

A conversion matrix $Mad^{-1}$ in Formula (4) means the inverse matrix of the chromatic adaptation conversion matrix Mad. By performing the operation of the inverse matrix of the chromatic adaptation conversion matrix Mad on the color gamut G1, the color gamut G3 that allows the color gamut G1 to be perceived under blue ambient light is obtained. That is, the following Relational Expression (7) holds.

[Formula 7]

$$\begin{pmatrix} L \\ M \\ S \end{pmatrix}_{G1} = Mad \begin{pmatrix} L \\ M \\ S \end{pmatrix}_{G3} \tag{7}$$

Mlx in Formula (5) is a conversion matrix for converting the LMS values into XYZ values. The conversion matrix Mlx is obtained as the inverse matrix of the conversion matrix Mxl.

Figure 5A:
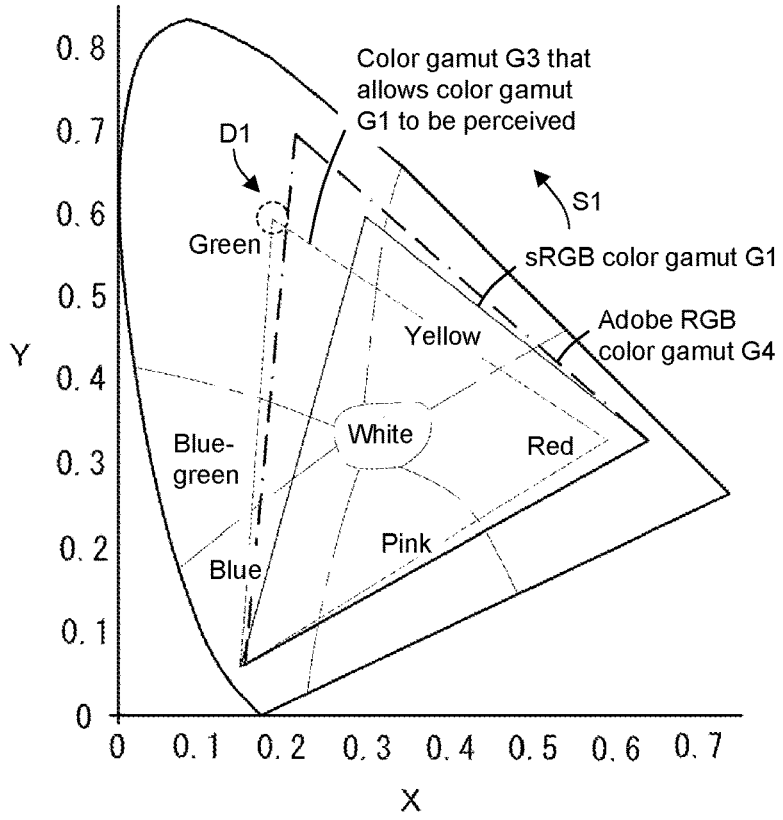
FIG. 5A is a chromaticity diagram showing step S1.

A chromaticity diagram of the color gamut G3 obtained in step Si is shown in FIG. 5A. As shown in FIG. 5A, the color gamut G3 is formed so as to be displaced from the color gamut G1 in a direction opposite to the direction of red.

Figure 5B:
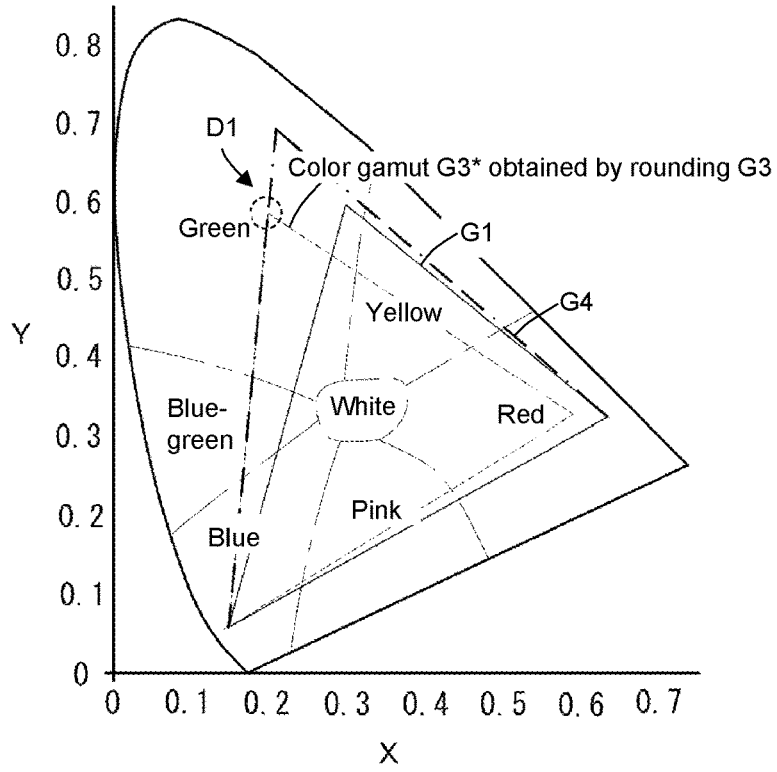
FIG. 5B is a chromaticity diagram showing step S2.

Then, in step S2, the correction matrix determination unit 61 performs a rounding process on the color gamut G3. As shown by an area D1 in FIG. 5A, the color gamut G3 includes an area outside Adobe RGB color gamut G4 displayable on the display unit 7. In this case, information on color components in this area is not properly displayed on the display unit 7. For this reason, a rounding process is performed on the color gamut G3 so that such information falls within the color gamut G4. Thus, as shown in FIG. 5B, rounded color gamut G3* is obtained.

Then, in step S3, the correction matrix determination unit 61 determines corrected color gamut G5. As shown by the area D1 in FIG. 6A, it is assumed that the green component of the corrected color gamut G5 has the same value as that of the color gamut G3* obtained in the rounding process of step S2. On the other hand, as shown by areas D2 and D3, it is assumed that the red and blue components of the corrected color gamut G5 have the same values as those of the color gamut G1. In this manner, the corrected color gamut G5 is determined.

Then, in step S4, the correction matrix determination unit 61 determines the correction matrix Mam. The correction matrix Mam is a conversion matrix for correcting the RGB values of the Adobe RGB color gamut G4, which are display characteristics of the display unit 7, so that the RGB values are displayed using the RGB values of the corrected color gamut G5 obtained in step S3. The correction matrix Mam is represented by the following Formulas (8) and (9).

[Formula 8]

$$\begin{pmatrix} R \\ G \\ B \end{pmatrix}_{G5} = Mam \begin{pmatrix} R \\ G \\ B \end{pmatrix}_{G4} \tag{8}$$

[Formula 9]

$$Mam = M_{rx}^{G5} \times M_{xr}^{G4} \tag{9}$$

Mrx in Formula (9) is a conversion matrix for converting the RGB values into XYZ values. The conversion matrix Mrx is obtained by determining the color gamut and the white point. As an example, a conversion matrix in a case in which the reference chromaticity P is white point D65 with respect to the sRGB color gamut G1 is represented as the following Formula (10). As used herein, the term "reference chromaticity" refers to chromaticity used as a reference before and after converting the color space. In other words, the reference chromaticity refers to a target point for moving the position of the corrected white point.

[Formula 10]

$$M_{rx}^{G1} = \begin{pmatrix} 0.412 & 0.357 & 0.180 \\ 0.212 & 0.715 & 0.072 \\ 0.019 & 0.119 & 0.950 \end{pmatrix} \tag{10}$$

Mxr in Formula (9) is a conversion matrix for converting the XYZ values into RGB values. The conversion matrix Mxr is obtained as the inverse matrix of the conversion matrix Mrx. That is, the conversion matrix Mxr is also obtained by determining the color gamut and the reference chromaticity P.

The correction matrix determination unit 61 determines the correction matrix Mam in Formula (9) on the basis of the color gamut G4 as display characteristics of the display unit 7, the corrected color gamut G5 obtained in steps until S3, and the reference chromaticity P and transmits the correction matrix Mam to the correction matrix operation unit 63.

The correction matrix operation unit 63 corrects the color components of the image data using the correction matrix Mam. Thus, the color gamut of the image data displayed on the display unit 7 is converted from the Adobe RGB color gamut G4 into the corrected color gamut G5. As a result, the user perceives images displayed on the display unit 7 with color gamut G6, which is perceived when viewing the corrected color gamut G5 under blue ambient light.

Figure 6A:
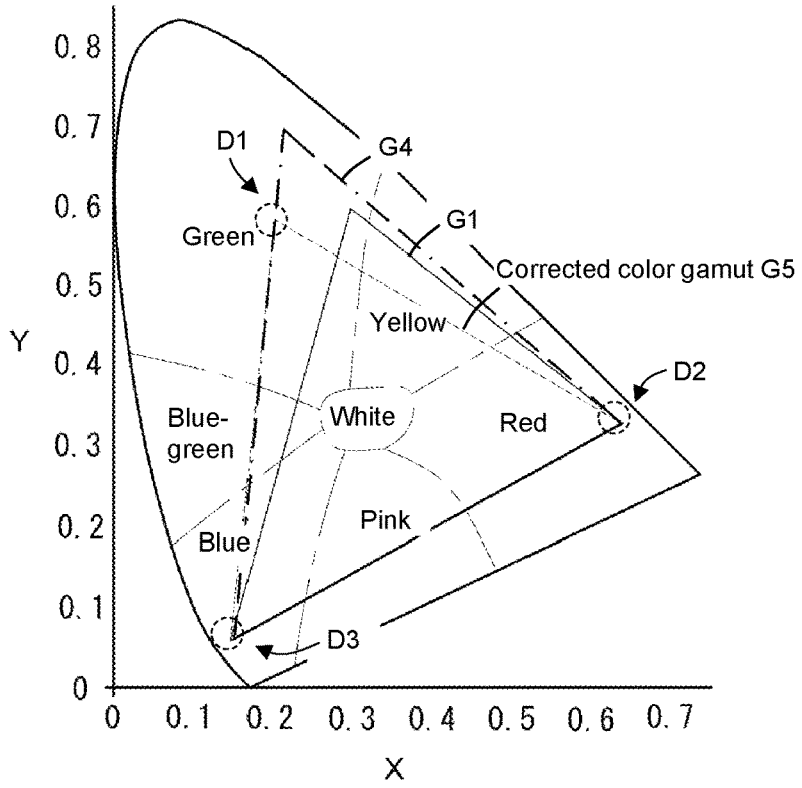
FIG. 6A is a chromaticity diagram showing step S3.
Figure 6B:
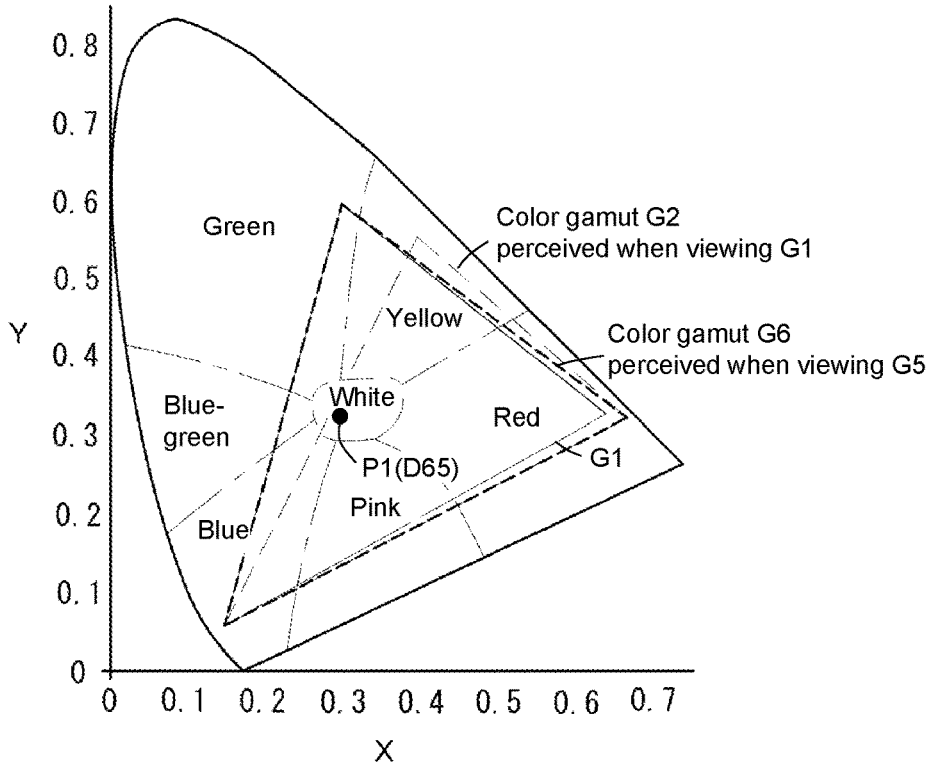
FIG. 6B is a chromaticity diagram showing changes in the color gamut by color space conversion.

FIG. 6B shows the color gamut G6 perceived when viewing the corrected color gamut G5 under blue ambient light. As shown in FIG. 6B, the green component of the color gamut G6 has almost the same value as that of the color gamut G1. This is because, in step S3, almost the same value as the green component of color gamut obtained by performing color gamut conversion Q on the color gamut G1 is set as the value of the corrected color gamut G5 (see the area D1 of FIGS. 5A and 5B). As a result, the perception of the greenish components of the image data under blue ambient light by the user comes close to the perception under white light.

On the other hand, the red component of the color gamut G6 has the same value as that of the color gamut G2 perceived when viewing the color gamut G1 under blue ambient light. This is because, in step S3, the same value as the red component of the color gamut G1 is set as that of the corrected color gamut G5 (see an area D2 in FIG. 6A). As a result, the user is able to more vividly perceive the red component of the image data under blue ambient light than under while light. As seen above, the image processing system 10 according to the present embodiment is able to reduce the influence of chromatic adaptation with respect to only the particular colors while enjoying the advantage of chromatic adaptation and thus to improve the visibility under colored ambient light.

(2.7. Modification 1)

Referring to FIGS. 7A and 7B, a modification 1 of the first embodiment will be described. In the above description, the ambient light is bluish light and therefore the color space converter 6 converts the color gamut such that, with respect to the greenish color components in the color gamut narrowed by the influence of chromaticity adaptation, the influence is canceled. On the other hand, in the modification 1, a case in which the ambient light is reddish light will be described.

FIG. 7A shows a color gamut G2 perceived when viewing an sRGB color gamut G1 in the case in which the ambient light is reddish light. As shown in FIG. 7A, the color gamut G2 is widened in the direction of green and narrowed in the direction of red compared to the color gamut G1, while it is almost not changed in the direction of blue. For this reason, in the modification 1, the color space converter 6 converts the color gamut such that, with respect to only the reddish colors, which are particular color components in color gamut narrowed by the ambient light, the influence of chromatic adaptation is canceled. The sRGB color gamut G1 and an Adobe RGB color gamut G4 have the same wideness in the directions of red and blue. Accordingly, in the modification 1, a display capable of displaying wider color gamut than the Adobe RGB color gamut is used.

FIG. 7B shows a color gamut G6 perceived when a corrected color gamut G5 determined by the correction matrix determination unit 61 in the modification 1 is viewed under red ambient light. As shown in FIG. 7B, even if the ambient light is reddish light, the color gamut is converted such that, with respect to in the direction of green, in which the color gamut is widened by the influence of chromaticity adaptation, the influence is maintained while, with respect to the direction of red, in which the color gamut is narrowed by the influence of chromaticity adaptation, the influence is canceled.

(2.8. Modification 2)

Referring to FIGS. 8A and 8B, a modification 2 of the first embodiment will be described. In the modification 1, the ambient light is reddish light and therefore the color gamut is converted such that, with respect to the reddish components in the color gamut narrowed by the influence of chromatic adaptation, the influence is canceled. On the other hand, in the modification 2, a case in which the ambient light is greenish light will be described.

FIG. 8A shows a color gamut G2 perceived when viewing an sRGB color gamut G1 in the case in which the ambient light is greenish light. As shown in FIG. 8A, the color gamut G2 is narrowed in the directions of green and red and widened in the direction of pink compared to the color gamut G1, while it is almost not changed in the direction of blue. For this reason, in the modification 2, the color space converter 6 converts the color gamut such that, with respect to only at least one of greenish components and reddish components, which are particular color components in color gamut narrowed by the ambient light, the influence of chromatic adaptation is canceled. The sRGB color gamut G1 and Adobe RGB color gamut G4 have the same wideness in the directions of red and blue. Accordingly, in the modification 2, a display capable of displaying wider color gamut than the Adobe RGB color gamut is used.

FIG. 8B shows a color gamut G6 perceived when a corrected color gamut G5 determined by the correction matrix determination unit 61 in the modification 2 is viewed under green ambient light. As shown in FIG. 8B, even if the ambient light is greenish light, the color gamut is converted such that, with respect to the direction of pink, in which the color gamut is widened by the influence of chromaticity adaptation, the influence is maintained while, with respect to the directions of red and green, in which the color gamut is narrowed by the influence of chromaticity adaptation, the influence is canceled.

(2.9. Modification 3)

Referring to FIGS. 9A and 9B, a modification 3 of the first embodiment will be described. In the modification 3, chromaticity other than white point D65 is set as the reference chromaticity P. By setting such a reference chromaticity P, the influence of chromatic adaptation on some intermediate colors (that is, the chromaticity inside the color gamut) is further canceled.

In an example shown in FIG. 9A, chromaticity P1 perceived as white due to the influence of the ambient light (bluish light) is set as the reference chromaticity P. The chromaticity P1 is obtained by the following Formulas (11) to (13) using the above-mentioned conversion matrix $Mad^{-1}$.

[Formula 11]

$$\begin{pmatrix} L \\ M \\ S \end{pmatrix}_{D65} = Mxl \begin{pmatrix} X \\ Y \\ Z \end{pmatrix}_{D65} \tag{11}$$

[Formula 12]

$$\begin{pmatrix} L \\ M \\ S \end{pmatrix}_{P1} = Mad^{-1} \begin{pmatrix} L \\ M \\ S \end{pmatrix}_{D65} \tag{12}$$

[Formula 13]

$$\begin{pmatrix} X \\ Y \\ Z \end{pmatrix}_{P1} = Mlx \begin{pmatrix} L \\ M \\ S \end{pmatrix}_{P1} \tag{13}$$

In this manner, the chromaticity P1 perceived as while due to the influence of the ambient light is obtained. The correction matrix Mam in Formula (9) is determined using the chromaticity P1 as the reference chromaticity P. By converting the color gamut using the correction matrix Mam thus obtained, the color components of the image data are corrected such that the influence of chromatic adaptation on intermediate colors is canceled. Specifically, by setting the reference chromaticity P such that the position of the corrected white point is shifted from D65 to the chromaticity P1, as shown in FIG. 9A, the color components of the image data are corrected such that the intermediate colors are shifted in the direction of arrows (that is, in the direction in which the influence of chromatic adaptation is canceled) on the basis of the reference chromaticity P.

Also, in an example shown in FIG. 9B, chromaticity P2 belonging to a color component in perceived color gamut widened by the influence of the ambient light is set as the reference chromaticity P. In the present embodiment, the ambient light is bluish light and therefore the color component in the widened perceived color gamut is red.

By setting the chromaticity P2 as the reference chromaticity P, the color components of the image data are corrected such that the influence of chromatic adaptation on some intermediate colors including weaker red components than the chromaticity P2 (in this case, intermediate colors including strong green components) is canceled while the influence of chromatic adaptation on intermediate colors including stronger red components than the chromaticity P2 is maintained, as shown by arrows in FIG. 9B.

As an example of a method for obtaining the chromaticity P2, it is possible to acquire, for each pixel, the chromaticity under while light of the image data inputted to the γ operation unit 62, and to use the average of the acquired chromaticity as the chromaticity P2. Or, any other method may be used to obtain the chromaticity P2.

3. Second Embodiment

Referring to FIG. 10, an image processing system 20 according to a second embodiment will be described. In the description below, the same elements as those in the first embodiment are given the same reference signs and will not be described.

As shown in FIG. 10, the image processing system 20 according to the second embodiment differs from the image processing system 10 according to the first embodiment in that an ambient light information acquisition unit 23 acquires ambient light information from a storage unit 8. That is, the ambient light information is previously registered in the storage unit 8, and the ambient light information acquisition unit 23 transmits the ambient light information acquired from the storage unit 8 to a chromatic adaptation calculator 4. Thus, there is no need to implement a color sensor as an ambient light information acquisition unit 33, resulting in a reduction in the cost. Note that multiple pieces of ambient light information may be registered in the storage unit 8 so that the user selects among the pieces of ambient light information on the setting screen.

4. Third Embodiment

Referring to FIG. 11, an image processing system 30 according to a third embodiment will be described.

As shown in FIG. 11, the image processing system 30 according to the third embodiment differs from the image processing system 10 according to the first embodiment in that an image display device 32 includes an ambient light information acquisition unit 33. Specifically, the ambient light information acquisition unit 33 acquires ambient light information in the environment in which the image display device 32 is disposed and transmits it to a chromatic adaptation calculator included in an image processing device 31. This allows the ambient light information to be more accurately obtained on a display unit 7 on which image data is displayed.

5. Fourth Embodiment

Referring to FIG. 12, an image processing device 41 according to a fourth embodiment will be described.

As shown in FIG. 12, the fourth embodiment provides the image processing device 41. The image processing device 41 includes an ambient light information acquisition unit 3, a chromatic adaptation calculator 4, and a color space converter 6. The color space converter 6 performs a color space conversion process on image data outputted from an image output device 45. This configuration allows the present invention to be applied to the existing image output device 45 and image display device 42.

6. Fifth Embodiment

Referring to FIG. 13, an image display device 52 according to a fifth embodiment will be described.

As shown in FIG. 13, the fifth embodiment provides the image display device 52. The image display device 52 includes an ambient light information acquisition unit 3 on which a color sensor is implemented, a chromatic adaptation calculator 4, a color space converter 6, and a display unit 7. The color space converter 6 performs a color space conversion process on image data outputted from an image output device 45. This configuration allows the present invention to be carried out in a form in which the configuration of the present invention is integrally incorporated into the image display device 52 including the display unit 7.

The image display device 52 may include a storage unit, and the ambient light information acquisition unit 3 may acquire ambient light information from the storage unit. That is, the ambient light information is previously stored in the storage unit, and the ambient light information acquisition unit 3 transmits the ambient light information acquired from the storage unit to the chromatic adaptation calculator 4. Thus, there is no need to implement a color sensor as the ambient light information acquisition unit 3, resulting in a reduction in the cost. Multiple pieces of ambient light information may be registered in the storage unit so that the user selects among the pieces of ambient light information on the setting screen.

7. Other Embodiments

The present invention is not limited to the above embodiments. For example, the adaptation factor D in Formula (2) may be changeable by the user so that the degree of correction of the color components in color space conversion is controllable.

Figure 4B:
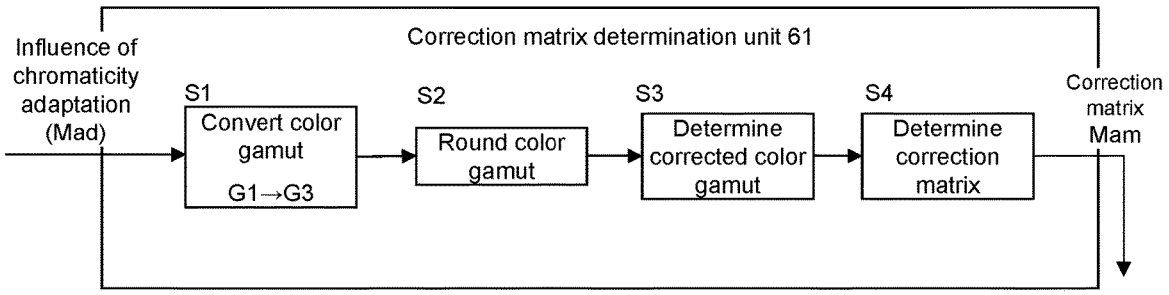
FIG. 4B is a diagram showing the flow of a process performed by a correction matrix determination unit 61.

While, in the above embodiments, the correction matrix determination unit 61 performs the color gamut rounding process in step S2 of FIG. 4B so that the color gamut falls within the Adobe RGB color gamut, the color gamut rounding process S2 may be omitted by using a display unit capable of displaying wider color gamut than the color space whose color gamut has been converted in step S1.

While, in the above embodiments, the image processing system 10 includes the ambient light information acquisition unit 3 and chromatic adaptation calculator 4, this example is not limiting. For example, the influence of chromatic adaptation on the basis of ambient light may be previously calculated, and the color space converter 6 may perform a color space conversion process on the basis of the influence of chromatic adaptation stored in the stored unit.

While, in the above embodiments, the chromatic adaptation calculator 4 calculates the chromatic adaptation conversion matrix Mad as the influence of chromatic adaptation, this example is not limiting. For example, the chromatic adaptation calculator 4 may calculate Lp, Mp, and Sp in Formula (2) and transmit them to the color space converter 6 as the influence of chromatic adaptation.

Also, the color space converter 6 may perform different conversion processes on multiple areas in the color space. For example, as shown in FIG. 14, the color space converter 6 may calculate different multiple correction matrixes Mam 1 to Mam7 with respect to multiple areas in the color space and correct the color components of the image data using these correction matrixes. While any method may be used to set the areas in the color space corresponding to the correction matrixes, the areas may be set such that the white point and nearby areas, and the other areas are converted using different conversion matrixes.

Also, the color space converter 6 may correct the color components of the image data using a lookup table storing the chromaticity correspondence between before and after converting the color space, rather than calculating the correction matrix Mam. In this case, the lookup table may be set such that the chromaticity of the white point and nearby areas appears to be white under ambient light (that is, the influence of chromatic adaptation is canceled in these areas) and such that the influence of chromatic adaptation is maintained in the other areas.

The present invention may be a computer program for causing a computer to perform an image processing method for converting a color space represented by color components of image data, the image processing method including a color space conversion step of correcting the color components of the image data by converting the color space such that, with respect to particular color components in user-perceived color gamut widened by influence of chromatic adaptation caused by ambient light, the influence is maintained and such that, with respect to particular color components in user-perceived color gamut narrowed by the influence, the influence is canceled.

Also, the present invention may be realized as a non-transitory computer-readable storage medium storing the above program.

While the various embodiments according to the present invention have been described, the embodiments are only illustrative and are not intended to limit the scope of the invention. Various omissions, replacements, or changes can be made to the above embodiments without departing from the spirit and scope of the invention. The resulting embodiments and modifications thereof are included in the spirit and scope of the present invention, as well as included in the scope of the invention set forth in the claims and equivalents thereof.

REFERENCE SIGNS LIST

10, 20, 30: image processing system, 1, 21, 31, 41: image processing device, 2, 32, 42: image display device, 3, 23, 33: ambient light information acquisition unit, 4: chromatic adaptation calculator, 5: image output unit, 6: color space converter, 7: display unit, 8: storage unit, 11: video signal cable, 12: control signal cable, 45: image output device, 61: correction matrix determination unit, 62: γ operation unit, 63: correction matrix operation unit, 64: display characteristics correction unit

The invention claimed is:

1. An image processing system for converting a color space represented by color components of image data, comprising:

a color space converter configured to correct the color components of the image data by converting the color space such that influence of chromatic adaptation caused by ambient light is maintained for particular color components belonging to a portion of a color gamut of the image data, wherein a perceived color gamut is widened relative to the color gamut in the portion due to the influence when a user perceives color in the color gamut under the ambient light, and such that the influence is canceled for particular color components belonging to another portion of the color gamut, wherein the perceived color gamut is narrowed relative to the color gamut in the another portion due to the influence when the user perceives color in the color gamut under the ambient light; and a display unit configured to display, as an output image, the image data using the corrected color components.

2. The image processing system of claim 1, further comprising:

an ambient light information acquisition unit configured to acquire information on the ambient light as ambient light information; and a chromatic adaptation calculator configured to calculate the influence of the chromatic adaptation caused by the ambient light on the basis of the acquired ambient light information and to output the influence of the chromatic adaptation to the color space converter.

3. The image processing system of claim 1, wherein the color components comprise three primary colors consisting of red, green, and blue, and when the ambient light is a bluish color and the particular color components belonging to the another portion include a greenish color.

4. The image processing system of claim 1, wherein the color components comprise three primary colors consisting of red, green, and blue, and when the ambient light is a reddish color, and the particular color components belonging to the another portion include a reddish color.

5. The image processing system of claim 1, wherein the color components comprise three primary colors consisting of red, green, and blue, and when the ambient light is a greenish color, the particular color components belonging to the another portion include a reddish color and/or a greenish color.

6. The image processing system of claim 1, wherein the display unit is configured to be able to display wider color gamut than the converted color space.

7. The image processing system of claim 1, wherein if the converted color space exceeds color gamut displayable on the display unit, the color space converter performs a rounding process on the color space so that the color space falls within the color gamut.

8. The image processing system of claim 7, wherein the color space of the image data is an sRGB color space, and a color space displayable on the display unit is color gamut defined by red where X=0.640 and Y=0.330, green where X=0.210 and Y=0.710, and blue where X=0.150 and Y=0.060.

9. The image processing system of claim 1, wherein the color space converter is configured to allow the user to control a degree of correction of the color components.

10. The image processing system of claim 2, wherein the ambient light information acquisition unit comprises a color sensor configured to detect color components of the ambient light as ambient light information.

11. The image processing system of claim 10, wherein the chromatic adaptation calculator calculates the influence of the chromatic adaptation by averaging the ambient light information detected by the color sensor in a predetermined period.

12. The image processing system of claim 1, wherein the color space converter sets reference chromaticity serving as a reference in conversion of the color space so that the influence of the chromatic adaptation on intermediate colors is further canceled.

13. The image processing system of claim 12, wherein the reference chromaticity is chromaticity perceived as white due to influence of the ambient light.

14. The image processing system of claim 12, wherein the color space converter is configured to convert the color space such that chromaticity of one color component belonging to a portion of the color gamut of the image data is fixed, and when the user perceives color in the color gamut under the ambient light, the perceived color gamut is widened relative to the color gamut in the portion due to the influence.

15. The image processing system of claim 1, wherein the color space converter performs different conversion processes on a plurality of areas in the color space.

16. An image processing device for converting a color space represented by color components of image data, the image processing device comprising a color space converter configured to correct the color components of the image data by converting the color space such that influence of chromatic adaptation caused by ambient light is maintained with respect to for particular color components belonging to a portion of a color gamut of the image data, wherein a perceived color gamut is widened relative to the color gamut in the portion due to the influence when a user perceives color in the color gamut under the ambient light, and such that the influence is canceled for particular color components belonging to another portion of the color gamut, wherein the perceived color gamut is narrowed relative to the color gamut in the another portion due to the influence when the user perceives color in the color gamut under the ambient light.

17. An image processing method for converting a color space represented by color components of image data, the image processing method comprising a color space conversion step of correcting the color components of the image data by converting the color space such that influence of chromatic adaptation caused by ambient light is maintained for particular color components belonging to a portion of a color gamut of the image data, wherein a perceived color gamut is widened relative to the color gamut in the portion due to the influence when a user perceives color in the color gamut under the ambient light, and such that the influence is canceled for particular color components belonging to another portion of the color gamut, wherein the perceived color gamut is narrowed relative to the color gamut in the another portion due to by the influence when the user perceives color in the color gamut under the ambient light, the influence is canceled.

18. A non-transitory computer-readable storage medium storing a computer program for causing a computer to perform an image processing method for converting a color space represented by color components of image data, the image processing method comprising a color space conversion step of correcting the color components of the image data by converting the color space such that influence of chromatic adaptation caused by ambient light is maintained for particular color components belonging to a portion of a color gamut of the image data, wherein a perceived color gamut is widened relative to the color gamut in the portion due to the influence when a user perceives color in the color gamut under the ambient light, and such that the influence is canceled for particular color components belonging to another portion of the color gamut, wherein the perceived color gamut is narrowed relative to the color gamut in the another portion due to by the influence when the user perceives color in the color gamut under the ambient light.

* * * * *